US011506001B2

(12) United States Patent
Rus

(10) Patent No.: US 11,506,001 B2
(45) Date of Patent: Nov. 22, 2022

(54) SYSTEM AND METHOD OF OBTAINING FORMATION SAMPLES USING COILED TUBING

(71) Applicant: Rus-tec Engineering, Ltd., Spruce Groe (CA)

(72) Inventor: Gustaaf Rus, Spruce Grove (CA)

( * ) Notice: Subject to any disclaimer, the term of this patent is extended or adjusted under 35 U.S.C. 154(b) by 0 days.

(21) Appl. No.: 17/566,759

(22) Filed: Dec. 31, 2021

(65) Prior Publication Data

US 2022/0205326 A1 Jun. 30, 2022

Related U.S. Application Data

(60) Provisional application No. 63/132,569, filed on Dec. 31, 2020.

(51) Int. Cl.

| | |
|---|---|
| ***E21B 7/02*** | (2006.01) |
| ***E21B 17/20*** | (2006.01) |
| ***E21B 19/22*** | (2006.01) |
| ***E21B 25/00*** | (2006.01) |

(52) U.S. Cl.

CPC ..... *E21B 17/20* (2013.01); *E21B 7/02* (2013.01); *E21B 19/22* (2013.01); *E21B 25/00* (2013.01)

(58) Field of Classification Search

CPC . E21B 7/02; E21B 17/20; E21B 19/22; E21B 25/00

See application file for complete search history.

(56) References Cited

U.S. PATENT DOCUMENTS

| | | | | |
|---|---|---|---|---|
| 2,643,858 | A | 6/1953 | Hardman | |
| 3,841,407 | A * | 10/1974 | Bozeman | E21B 19/22 226/173 |
| 4,969,528 | A | 11/1990 | Jurgens | |
| 5,667,025 | A | 9/1997 | Haessly et al. | |
| 6,003,598 | A * | 12/1999 | Andreychuk | E21B 19/22 166/77.2 |
| 6,439,618 | B1 * | 8/2002 | Beeman | E21B 17/04 285/322 |
| 7,152,672 | B1 | 12/2006 | Gipson | |
| 7,240,744 | B1 | 7/2007 | Kemick | |
| 7,516,798 | B2 | 4/2009 | Wood et al. | |
| 8,408,288 | B2 * | 4/2013 | Havinga | E21B 15/00 166/77.2 |
| 8,678,109 | B2 | 3/2014 | Orban et al. | |
| 8,757,293 | B2 | 6/2014 | Livingstone | |
| 9,797,196 | B2 * | 10/2017 | Taggart | E21B 19/083 |
| 9,850,713 | B2 | 12/2017 | Haci | |
| 9,915,111 | B2 * | 3/2018 | Rousseau | E21B 19/22 |
| 10,995,563 | B2 * | 5/2021 | Søe | E21B 19/22 |
| 2004/0140131 | A1 | 7/2004 | Susman | |

(Continued)

FOREIGN PATENT DOCUMENTS

WO 2007027683 3/2007

*Primary Examiner* — Matthew R Buck

(74) *Attorney, Agent, or Firm* — Bushman Werner, P.C.

(57) ABSTRACT

A mobile coiled tubing rig and method for obtaining samples from a formation. The rig having a carrier, a coiled tubing reel positioned on the carrier, a mast pivotally mounted on the carrier, a coiled tubing injector mounted on the mast, at least one wrench for connecting components to the coiled tubing and to each other to form the bottom hole assembly. The rig is operable to perform earth coring operations and/or reverse circulation drilling to obtain samples of a formation for analysis.

15 Claims, 7 Drawing Sheets

(56) References Cited

U.S. PATENT DOCUMENTS

| | | | | |
|---|---|---|---|---|
| 2004/0206551 | A1 | 10/2004 | Carriere et al. | |
| 2005/0252687 | A1 | 11/2005 | Egerstrom | |
| 2006/0231267 | A1 | 10/2006 | Wood | |
| 2007/0125549 | A1 | 6/2007 | Wood | |
| 2007/0209791 | A1 | 9/2007 | Havinga | |
| 2007/0215349 | A1 | 9/2007 | Reid et al. | |
| 2008/0156537 | A1 | 7/2008 | Stockton | |
| 2009/0178847 | A1 | 7/2009 | Nellessen, Jr. et al. | |
| 2011/0247881 | A1 | 10/2011 | Orban et al. | |
| 2013/0056276 | A1 | 3/2013 | Rousseau et al. | |
| 2014/0124219 | A1* | 5/2014 | Dirksen | E21B 17/05 166/380 |
| 2017/0234085 | A1* | 8/2017 | Gaska | E21B 19/163 166/77.51 |

* cited by examiner

SYSTEM AND METHOD OF OBTAINING FORMATION SAMPLES USING COILED TUBING

CROSS-REFERENCE TO RELATED APPLICATION

This application claims priority to U.S. Application No. 63/132,569 filed on Dec. 31, 2020, the disclosure of which is incorporated herein by reference for all purposes.

FIELD OF THE INVENTION

The present invention relates to a system for obtaining samples from an earth formation, more particularly, to surface coring and/or reverse circulation drilling using a mobile coiled tubing system.

BACKGROUND OF THE INVENTION

A key component of mining operations is the analysis of the formation to be mined. There are multiple processes for obtaining samples of a potential mining formation for analysis. Two major processes are core drilling and reverse circulation drilling.

Core drilling is performed to obtain an undisturbed, intact sample representative of the material in a particular location. Coring processes are used in many industries, including mining, construction, oil and gas, as well as in geological studies.

In a typical coring operation, a borehole is drilled and casing is installed. The coring tool, e.g., coring barrel, is attached to a series of threaded pipe segments and lowered into bore hole to obtain the core samples. The installation and removal of the coring tool thus requires the make-up and break out of multiplate sections of pipe. In some cases a wireline operation may be used which reduces the number of connections to be made up and broken out. However, in either case, the process can be time consuming.

In reverse circulation drilling, rather than obtaining an intact sample of the formation, the cuttings from the drilling are collected. In typical drilling, drilling fluids/mud are pumped down the drill string and the fluid and cuttings return to the surface through the annulus formed between the drill string and the borehole. In reverse circulation drilling, the fluids are pumped down the annulus and the cuttings return up through a specialized drill rod having a hollow portion for receiving the cuttings. This allows for analysis of the cuttings which have not been cross-contaminated through exposure to other parts of the borehole.

The prior art is replete with examples of mobile systems for performing coiled tubing and threaded tubular operations, including coring operations. In particular, U.S. Pat. No. 9,915,111, incorporated herein by reference for all purposes, discloses a mobile rig including coiled tubing system for drilling and a top drive for rotating threaded tubulars during coring operations. Other examples of mobile rigs include U.S. Pat. Nos. 6,976,979; 7,845,398; and 8,408,288, the discloses of which are all incorporated herein by reference for all purposes. All of the above-listed patents disclose combination rigs which handle both coiled tubing and threaded tubulars.

The present invention provides a compact, lightweight mobile rig for performing formation sampling operations using coiled tubing without the need for threaded tubulars.

SUMMARY OF THE INVENTION

In one aspect, the present invention relates to a method of obtaining samples from a formation using a mobile coiled tubing rig.

In another aspect, the present invention relates to a coiled tubing system for obtaining core samples from a formation.

In yet another aspect, the present invention relates to a method of coring using a coiled tubing system.

In still another aspect, the present invention relates to a mobile coiled tubing rig.

These and further features and advantages of the present invention will become apparent from the following detailed description, wherein reference is made to the figures in the accompanying drawings.

DETAILED DESCRIPTION OF PREFERRED EMBODIMENTS

Figure 1A:
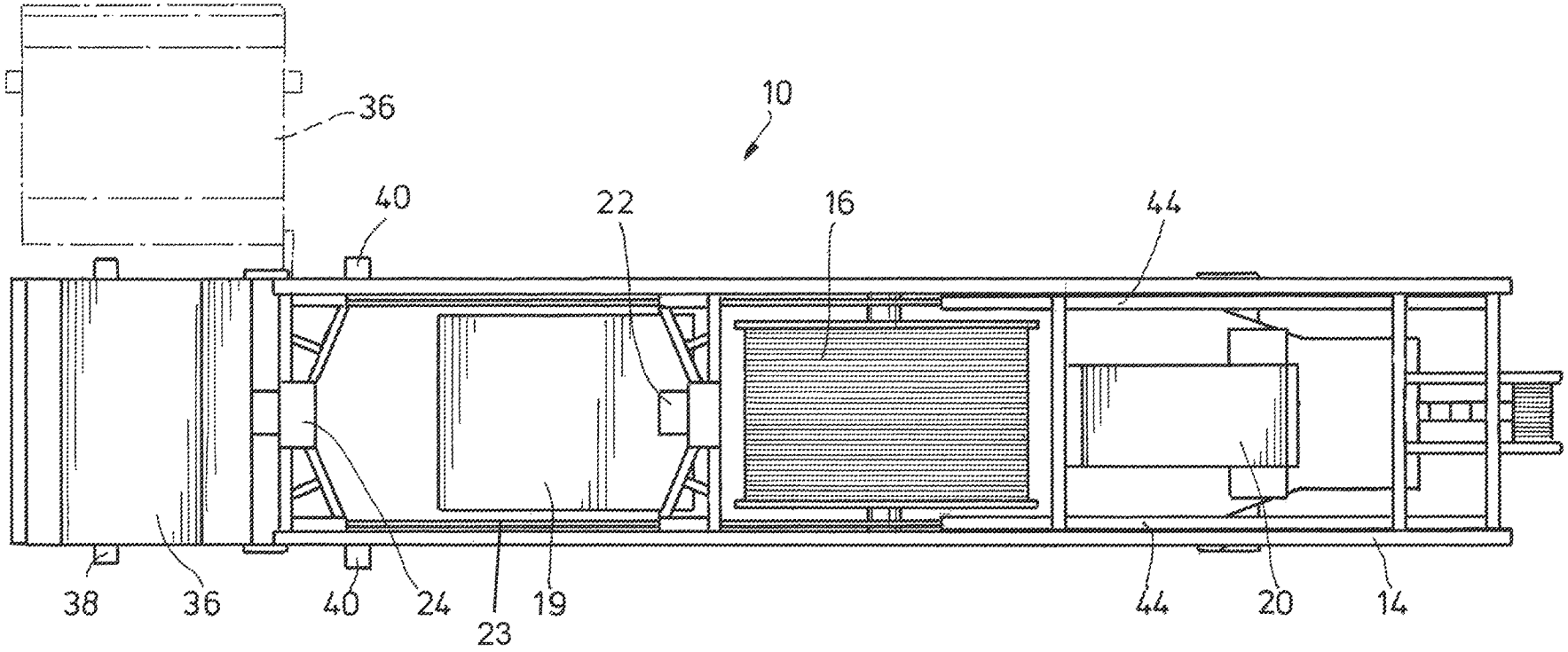
FIG. 1A shows a top plan view of the coiled tubing system of the present invention when in transport mode.

Turning to the drawings, there is shown generally as 10 a coiled tubing rig of the present invention. Coiled tubing rig 10 comprises a carrier 12 on which are mounted mast 14, tube reel 16, tube reel drive 18, and power pack 19. Mounted on mast 14 is injector 20 which includes arched guide arm 21. Also mounted on mast 14, below injector 20 are upper torque wrench 22 and lower torque wrench 24. It will be appreciated that while the system is depicted with two torque wrenches, it may operate with only a single torque wrench. Rig 10 preferably has a hitch 26 which can be used to selectively connect to mud tank trailer 30 or other equipment which may be necessary at a site.

Figure 1B:
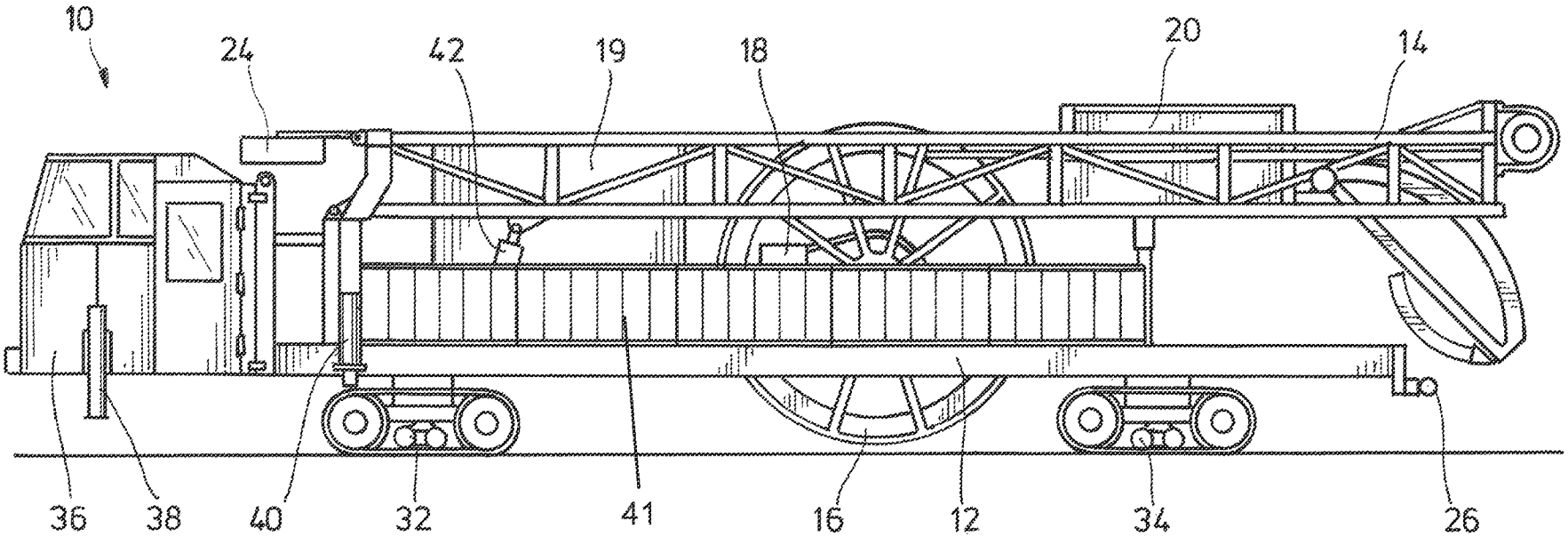
FIG. 1B shows a side elevational view of the coiled tubing system of the present invention when in transport mode.

In FIGS. 1A and 1B, mast 14 is shown in transport position. When preparing for the coring process, rig 10 is driven into position on pairs of front and rear tracks 32, 34. Mud tank trailer 30 can be disconnected and positioned a short distance away from the drilling location. Once in position, two way cab 36 is pivoted away from carrier 12 (see FIG. 2B). Cab leveling jacks 38 are lowered to hold cab 36 in position during the coring process. Outriggers 40 are lowered to hold carrier 12 in position during the coring process.

Figure 2A:
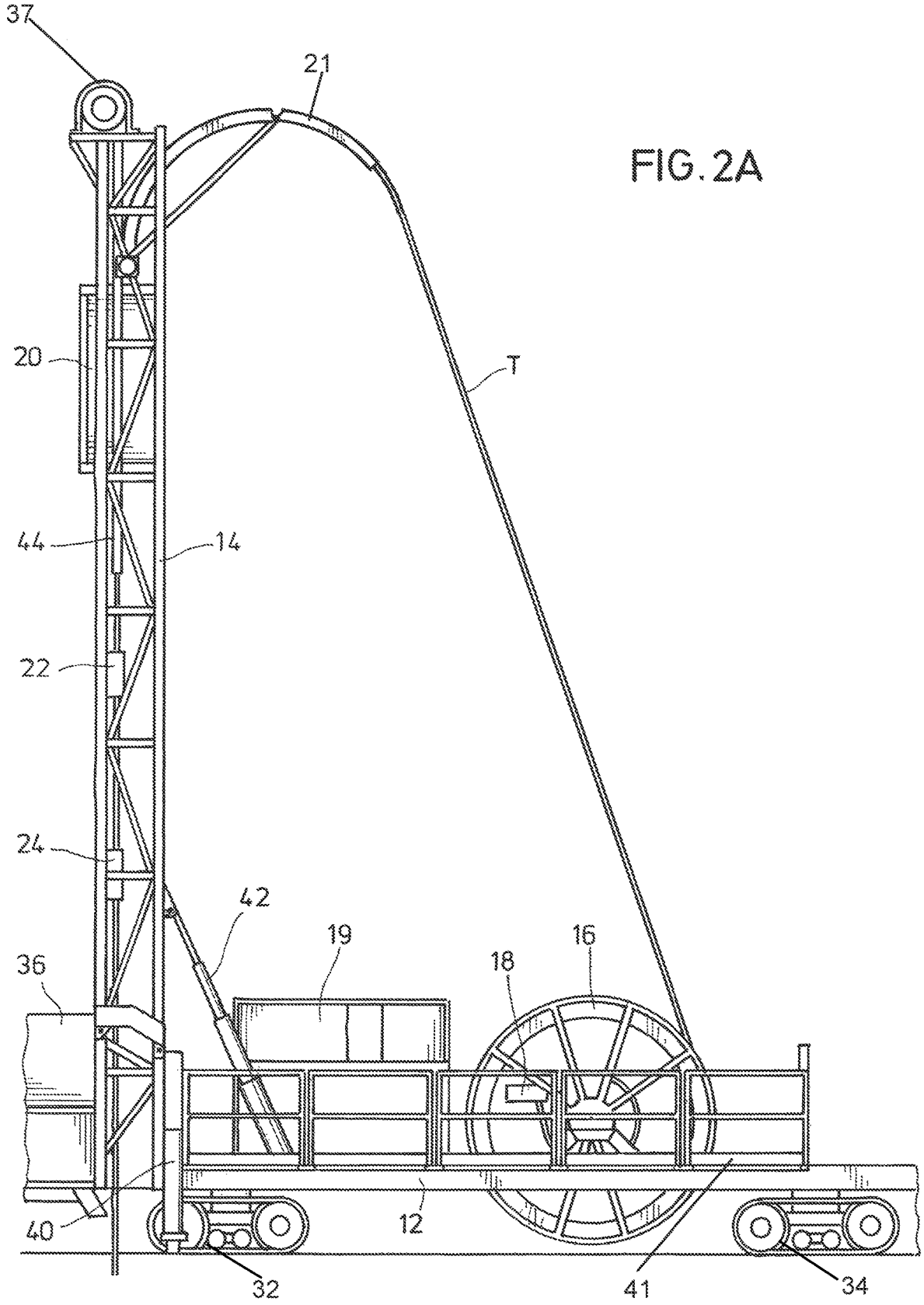
FIG. 2A shows a side elevational view of the coiled tubing system of the present invention during operation.
Figure 2B:
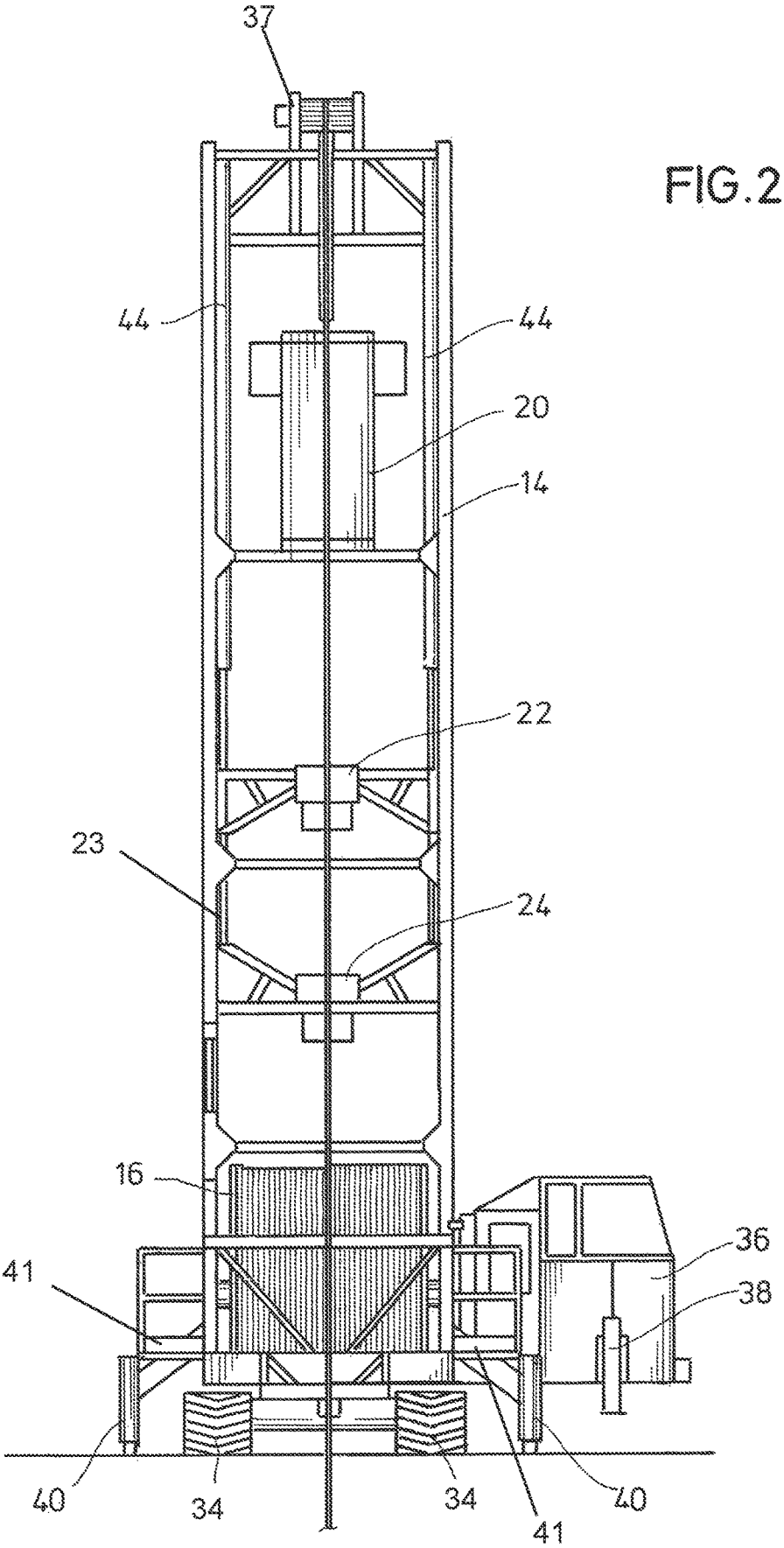
FIG. 2B is a rear elevational view of the coiled tubing system of the present invention.

As shown in FIGS. 2A and 2B, mast 14 is raised to the desired drilling angle using a pair of telescoping mast raise arms 42. The system of the present invention is capable of drilling vertically or at angles of up to 45° from vertical. Arms 42 can be hydraulically, pneumatically, or electronically operated as will be well known to those skilled in the art. It will be appreciated that various components which are necessary for the operation of the present invention are not described in detail, e.g., hydraulic connections, actuators, motors, power supplies, and the like. These components are well known to one or ordinary skill in the art and need not be described in detail.

In a preferred embodiment, rig 10 includes foldable platforms 41. As seen in FIGS. 1A and 1B, during transport platforms 41 are folded such that the rig is no wider than cab 26. Turning to FIG. 2A and, in particular FIG. 2B, it can be seen that platforms 41, extend out from the rig. The platforms fold using hinges well known to those skilled in the art and can be held in place during transport by any means well known to those skilled in the art. Platforms 41 preferably include railings around the periphery for improved safety.

Torque wrenches 22 and 24 are used to make up and break connections of various tools and components connected to the coiled tubing T. Upper wrench 22 can be raised or lowered along the mast as needed using piston assemblies 44 which extend from the top of mast 14. Piston assemblies 44 can be driven by hydraulics, pneumatics, or electronics. Lower wrench 24 is not driven on its own but can be selectively connected to upper wrench 22 to move with it. For example, one or more wrench connector bars 23 can extend between upper and lower wrenches such that the upper wrench 22 or lower wrench 24 can connect to/disconnect from the connector bar 23. The method of connecting to bar 23 can be any means well known to those skilled in the art, e.g., via threaded nut/bolt connections. When both upper and lower wrenches are connected to connector bar 23, movement of upper wrench 22 along mast 14 will also move lower wrench 24 along mast 14. If one or both of the wrenches 22, 24 is not connected to bar 23, then only upper wrench 22 will be able to move along mast 14 while lower wrench 24 remains at its lowermost position along the mast. This configuration of the wrenches provides flexibility for handling different tools, subs, and components, which form the bottomhole assembly connected to the coiled tubing. The wrenches can be spaced apart or moved together to different heights along the mast.

It will be appreciated that the full bottomhole assembly used during coring may include additional components well known to those skilled in the art, including but not limited to, cross-over subs, centralizers, jarring devices, stabilizers, rotors, stators, and the like. Such components are well known and thus not described in detail. As used herein, the term bottomhole assembly (BHA) is intended to include all such components typically used in an operation. For example, a "drilling BHA" would include components typically used in drilling operations. Likewise, a "coring BHA" includes components used in coring operations in addition to the coring assembly 60 described below.

Figure 4:
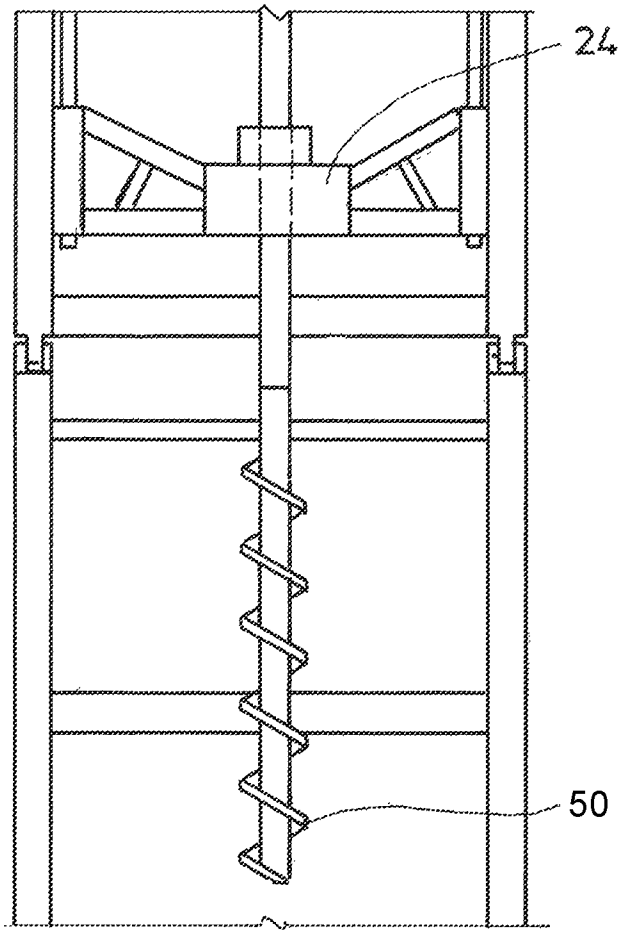
FIG. 4 shows an auger connected to the coiled tubing system of the present invention.

For surface coring operations the borehole typically extends under 200 meters (about 660 feet) down. For such shallow drilling an auger can be used to drill the initial bore hole. As shown in FIG. 4, auger 50 is held in place by lower wrench 24. Wrenches 22 and 24 are connected together and move together to lower the auger into the ground and drill out a shallow borehole. After the initial borehole is drilled, auger 50 is removed. For deeper operations, a drilling assembly can be connected to the coiled tubing T and the borehole can be drilled out with a typical drilling BHA well known to those skilled in the art. The boreholes are lined with casing as is well known to those skilled in the art. It will also be appreciated that the auger can be connected to the coiled tubing which would lower and raise the auger into and out of the ground.

Figure 3B:
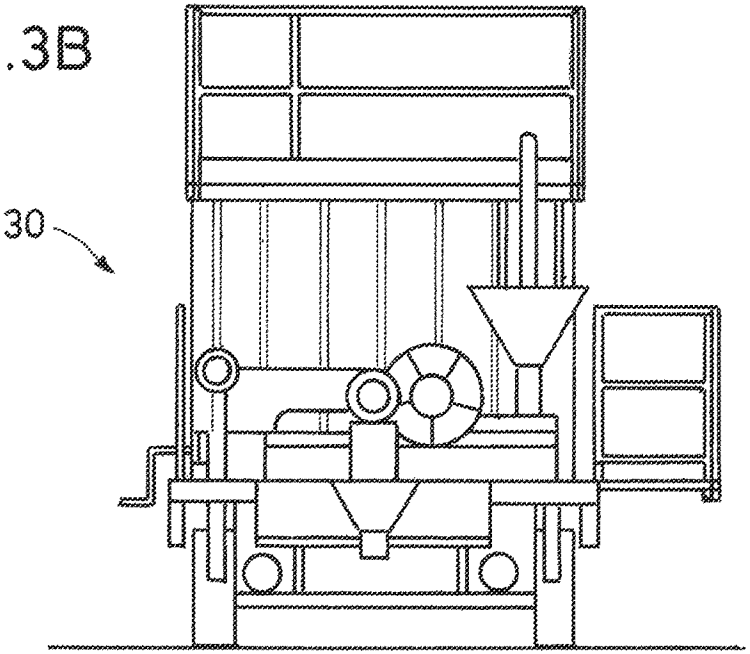
FIG. 3B is a rear elevational view of the mud tank trailer used with the coiled tubing system of the present invention.
Figure 3A:
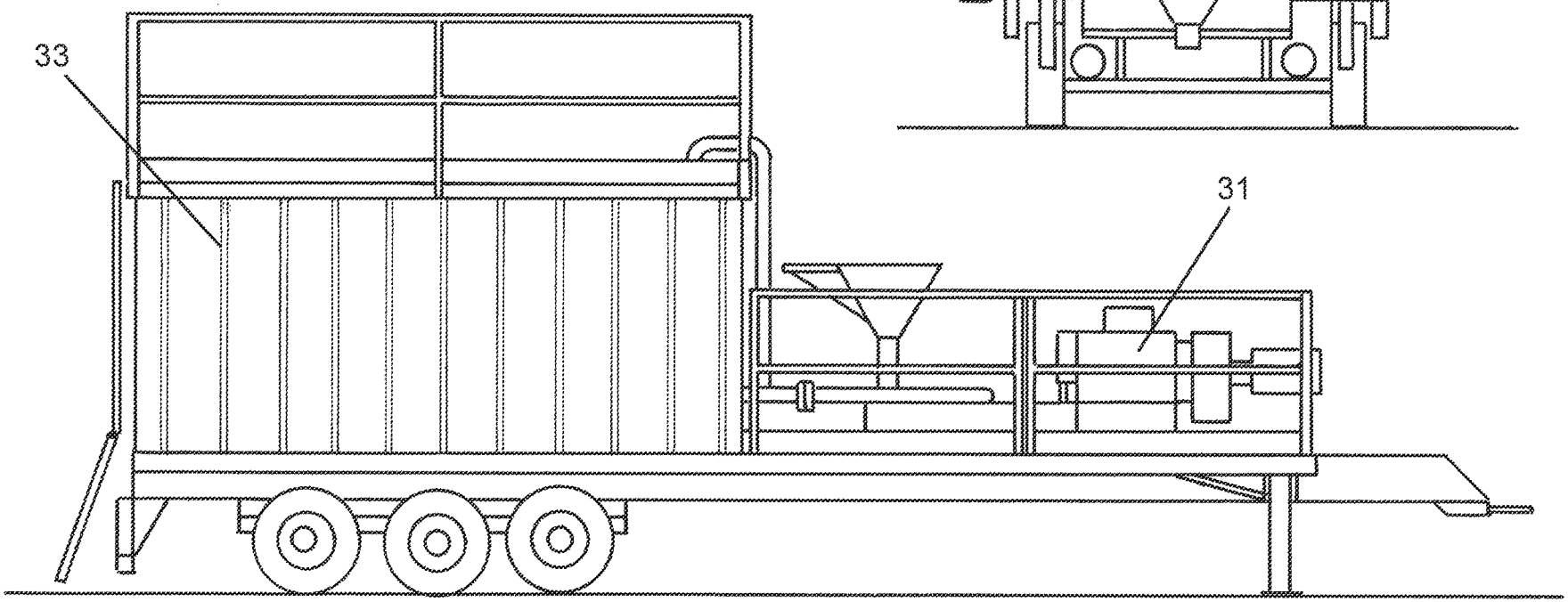
FIG. 3A is a side elevational view of the mud tank trailer used with the coiled tubing system of the present invention.
Figure 5:
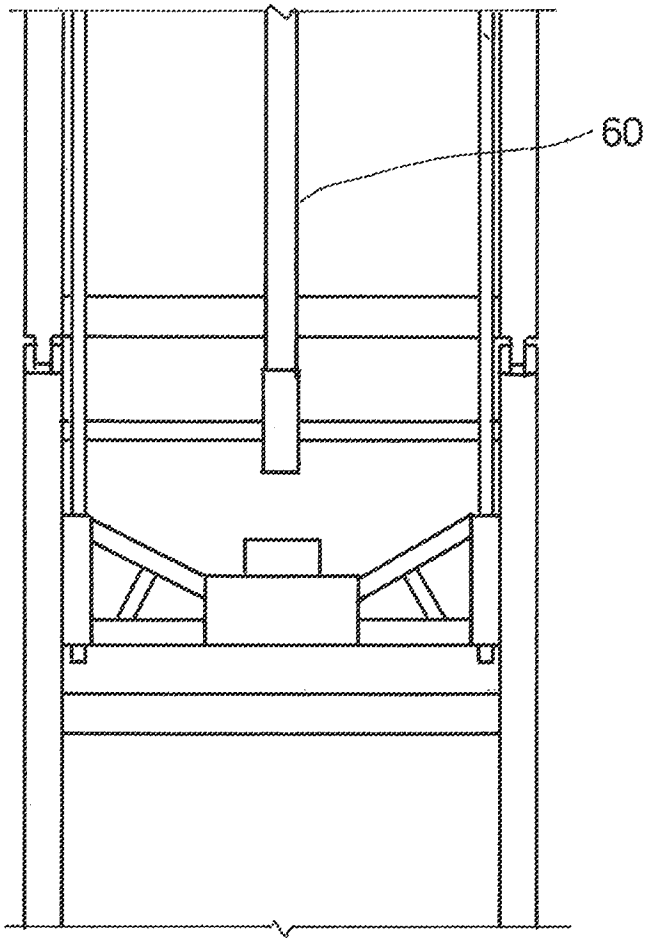
FIG. 5 shows a coring assembly connected to the coiled tubing system of the present invention.
Figure 6:
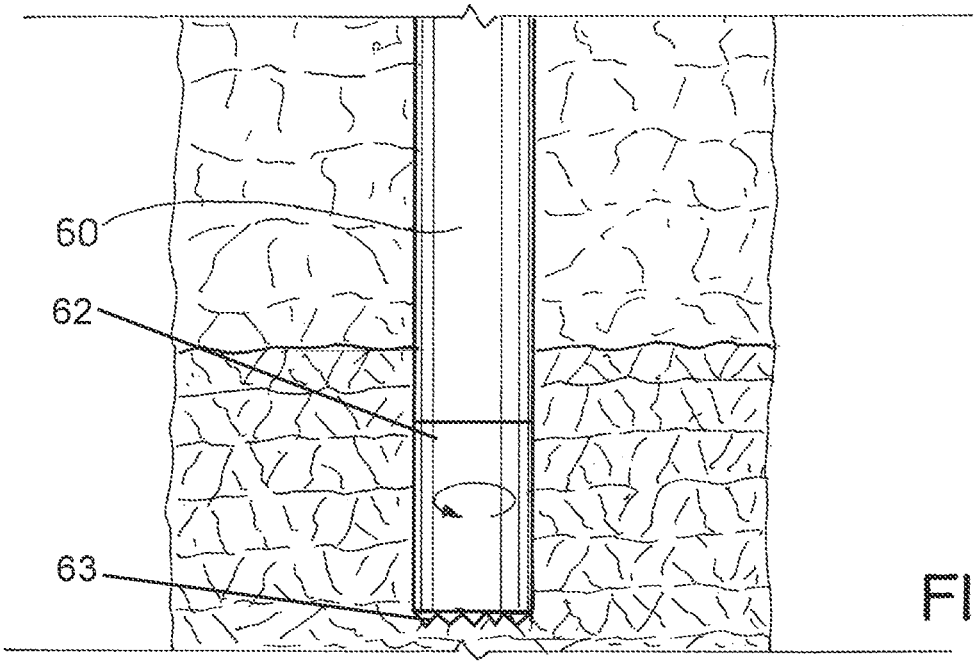
FIG. 6 shows the coring assembly digging out a core sample.
Figure 7:
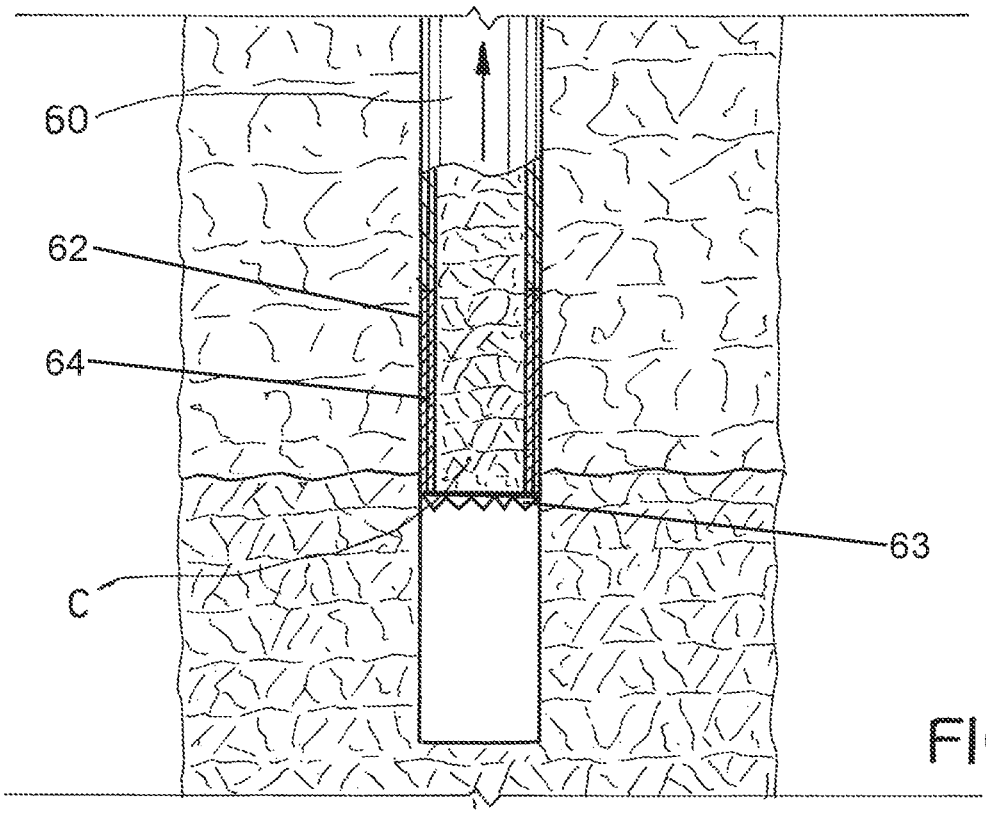
FIG. 7 shows the coring assembly in section with the core sample being retrieved back to the surface.

To take the coring sample, the coiled tubing T is fed through injector 20 by means well known to those skilled in the art. As seen in FIG. 5, a coring assembly shown generally as 60 and a downhole motor (not shown) are connected to coiled tubing T. Coring assembly 60 comprises an external rotary tube 62 which terminates with cutting teeth 63, and an internal static barrel 64 which does not rotate. The downhole motor can be of a type well known to those skilled in the art, including but not limited to, mud-driven turbines, positive displacement mud motors, electrically powered motors. Upper and/or lower wrenches 22 and 24 are be used to make up and break the connections of the various components used to form the coring BHA. In a preferred embodiment, a quick disconnect sub is installed such that the coring assembly 60 can be quickly attached and removed. To obtain the core samples, the coring assembly 60 is lowered by coiled tubing T into the borehole (see FIG. 6). In a preferred embodiment, coiled tubing T passes through wrenches 22 and 24 and in this way, wrenches 22 and 24 stabilize the line of coiled tubing T and keep it in alignment with the borehole. The mud tank trailer 30 is positioned nearby. As seen in FIGS. 3A-3B, the mud tank trailer 30 includes a mud pump 31 for providing drilling fluids/mud to the downhole motor and a mud tank 33 which receives cuttings. The downhole motor rotates the external rotary tube 62 such that teeth 63 dig down into the earth. As the coring assembly 60 moves further into the earth, core sample C is driven into internal barrel 64 and held in place by friction or by means well known to those skilled in the art. Once the core sample C has been taken, the coiled tubing T is reeled back in and lifts the coring assembly out of the borehole (see FIG. 7). The coring process can be repeated by removing and replacing the used coring assembly with an empty coring assembly. Again, a quick disconnect sub ensures this step can be done quickly and easily.

After the coring process is complete, the coring assembly is removed from the coiled tubing T, coiled tubing T is fully reeled in, mast 14 is lowered, cab 36 is moved back into its driving position, and rig 10 moved to another location. If it is safe to do so, mast 14 can remain in a raised position while moving rig 10 to the next coring location.

In a preferred embodiment, there is a winch 37 positioned at the top of the mast. Winch 37 can be used to lift the various components, e.g., the auger 50 and coring assembly 60, into position for one or more of wrenches 22 and 24 to grasp them. Likewise, winch 37 can be used during removal of the components and can safely lower them back to the ground.

In addition to coring operations, the present coiled tubing rig 10 of the present invention can be used in reverse circulation drilling processes as well. As with the coring process, the components for reverse circulation drilling will be connected to the coiled tubing string using the wrenches 22 and/or 24. The components will include a drill rod having a hollow portion for receiving the cuttings well known to those skilled in the art. The reverse circulation BHA is lowered and raised into and out of the borehole by letting out and reeling in the coiled tubing T. Cuttings from the borehole can be collected in mud tank 33 for further analysis.

Unlike prior art rigs which use connected segments of threaded tubulars to drive the coring assembly downhole, the present invention uses coiled tubing to raise and lower all the drilling and coring components. By eliminating the steps of connecting and disconnecting multiple segments of pipe, the present invention saves time, reduces cost, and improves safety by reducing the amount of human interaction required. Additionally, because there is no top drive, Kelly drive, rotary table, or other threaded tubular drive system, the system of the present invention is lighter in weight and easier to transport than the prior art combination rigs.

The coiled tubing rig of the present invention is also much more compact than prior art systems. Prior art rigs are often mounted on mobile trailers/carriers which can be hooked up to truck cabs for transport. This requires fully disconnecting the cab between uses and increases the amount of time required for the process overall. Additionally, as previously mentioned the prior art rigs are combination rigs which include coiled tubing equipment as well as top drives and other equipment for handling threaded tubulars. This extra equipment increases the weight of the system. The present invention is more lightweight and compact. Additionally, it uses a pivoting cab which allows eliminates the time consuming steps of fully disconnecting and removing the cabs before drilling, and then repositioning and reconnecting the cab afterwards.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A mobile rig for collecting samples from a formation, comprising:

a carrier;

a mast pivotally mounted on said carrier;

a reel of coiled tubing being mounted on said carrier;

a coiled tubing injector mounted on said mast;

a first wrench mounted on said mast, said first wrench being longitudinally movable along said mast;

wherein said first wrench is operable to removably connect a tool to said coiled tubing; and wherein said coiled tubing injector is operable to move said tool into and out of a borehole.

2. The rig of claim 1, wherein said tool comprises a coring assembly or a reverse circulation drilling assembly.

3. The rig of claim 1, wherein said first wrench is operable to removably connect to an auger and to lower said auger into the ground to drill out an initial portion of the borehole.

4. The rig of claim 1, further comprising a second wrench mounted below said first wrench on said mast.

5. The rig of claim 4, wherein said second wrench is selectively connectable to said first wrench for longitudinal movement therewith along said mast.

6. The rig of claim 1, further comprising a cab pivotally connected to said carrier such that said cab can be pivoted to the side to be offset from said carrier.

7. The rig of claim 1, wherein said coiled tubing passes through said first wrench.

8. A method for collecting samples from a formation, comprising:

providing a carrier;

providing a mast pivotally mounted on said carrier;

providing a reel of coiled tubing being mounted on said carrier;

providing a coiled tubing injector mounted on said mast;

providing a first wrench mounted on said mast, said first wrench being longitudinally movable along said mast;

removably connecting a tool to said coiled tubing using said first wrench; and using said coiled tubing injector to move said tool into and out of a borehole.

9. The method of claim 8, wherein said tool comprises a coring assembly or a reverse circulation drilling assembly.

10. The method of claim 8, further comprising using said first wrench to removably connect an auger and lowering said auger into the ground to drill out an initial portion of the borehole.

11. The method of claim 8, further comprising providing a second wrench mounted below said first wrench on said mast.

12. The method of claim 11, further comprising selectively connecting said second wrench to said first wrench for longitudinal movement therewith along said mast.

13. The method of claim 8, further comprising providing a cab pivotally connected to said carrier such that said cab can be pivoted to the side to be offset from said carrier.

14. The method of claim 8, wherein said coiled tubing passes through said first wrench.

15. The method of claim 8, further comprising pivoting said mast to be at about 45° relative to the ground.

* * * * *